US010094006B2

(12) United States Patent
Lee et al.

(10) Patent No.: US 10,094,006 B2
(45) Date of Patent: Oct. 9, 2018

(54) METHOD OF FABRICATING AN ALUMINUM MATRIX COMPOSITE AND AN ALUMINUM MATRIX COMPOSITE FABRICATED BY THE SAME

(71) Applicants: Alcom, Incheon (KR); Senus Corp., Incheon (KR)

(72) Inventors: Kon-Bae Lee, Seoul (KR); Jae-Pyoung Ahn, Seoul (KR); Hae Sung Kim, Seoul (KR); Hyunjoo Choi, Seoul (KR)

(73) Assignees: ALCOM, Incheon (KR); SENUS CORP., Incheon (KR)

( * ) Notice: Subject to any disclaimer, the term of this patent is extended or adjusted under 35 U.S.C. 154(b) by 430 days.

(21) Appl. No.: 14/792,503

(22) Filed: Jul. 6, 2015

(65) Prior Publication Data

US 2016/0168668 A1 Jun. 16, 2016

(30) Foreign Application Priority Data

Dec. 15, 2014 (KR) ..... 10-2014-0180608
Jun. 24, 2015 (KR) ..... 10-2015-0089370

(51) Int. Cl.

| | |
|---|---|
| ***C22C 1/05*** | (2006.01) |
| ***C22C 32/00*** | (2006.01) |
| ***C23C 8/24*** | (2006.01) |
| ***C22C 21/06*** | (2006.01) |

(52) U.S. Cl.

CPC ..... *C22C 32/0005* (2013.01); *C22C 1/05* (2013.01); *C22C 21/06* (2013.01); *C23C 8/24* (2013.01); *B22F 2201/02* (2013.01)

(58) Field of Classification Search

CPC ..... C22C 1/05; C22C 32/0005
USPC ..... 148/207
See application file for complete search history.

(56) References Cited

U.S. PATENT DOCUMENTS

| | | | |
|---|---|---|---|
| 4,713,360 | A | 12/1987 | Newkirk et al. |
| 4,824,008 | A | 4/1989 | Luszcz et al. |
| 5,856,025 | A | 1/1999 | White et al. |

FOREIGN PATENT DOCUMENTS

| | | | |
|---|---|---|---|
| JP | 2002-371330 | A | 12/2002 |
| KR | 10-0307646 | B1 | 5/2002 |

OTHER PUBLICATIONS

M.K. Surappa, "Aluminum Matrix Composites: Challenges and Opportunities", Sadhana Acadamy Proceedings in Engineering Sciences, Feb./Apr. 2003, pp. 319-334, vol. 28, Parts 1 & 2, Springer, India.

K.U. Kainer, "Basics of Metal Matrix Composites", ed. Metal Matrix Composites. Custom-Made Materials for Automotive and Aerospace Engineering, 2006, pp. 1-54, Wiley-VCH, Germany.

(Continued)

*Primary Examiner* — Brian Walck
(74) *Attorney, Agent, or Firm* — GW Suh Patent Services

(57) ABSTRACT

The present invention is related to a method of fabricating an aluminum matrix composite by a simple process of heating a mixture of a ceramic reinforcing phase and aluminum in nitrogen containing atmosphere and an aluminum matrix composite fabricated by the same. The aluminum matrix composite may be fabricated by heating to temperatures even lower than the melting temperature of aluminum as well as to temperatures higher. The exothermic nitridation reaction contributes to the melting of the aluminum matrix and the aluminum nitride formed in-situ as a result may act as an additional reinforcing phase.

26 Claims, 3 Drawing Sheets

(56) References Cited

OTHER PUBLICATIONS

M. Balog et al., "Nanoscaled Al—AlN composites consolidated by equal channel angular pressing (ECAP) of partially in situ nitrided Al powder", Materials Science & Engineering, 2013, pp. 190-195, vol. A 562, Elsevier.
X. Qu et al., "Review of metal matrix composites with high thermal conductivity for thermal management applications", Progress in Natural Science: Materials International, 2011, pp. 189-197, vol. 21, No. 3, Elsevier.
S. Mallik et al., "Investigation of thermal management materials for automotive electronic control units", Applied Thermal Engineering, 2011, pp. 355-362, vol. 31, No. 2, Elsevier.
R. Prieto et al., "Fabrication and properties of graphite flakes/metal composites for thermal management applications", Scripta Materialia, 2008, pp. 11-14, vol. 59, No. 1, Elsevier.
M.A. Occhionero et al., "Aluminium silicon carbide (AlSiC) for cost-effective thermal management and functional microelectric packaging design solutions", 12th European Microelectronics and Packaging Conference, Jun. 7-9, 1999, pp. S10-S04, vol. 8.

FIG. 2
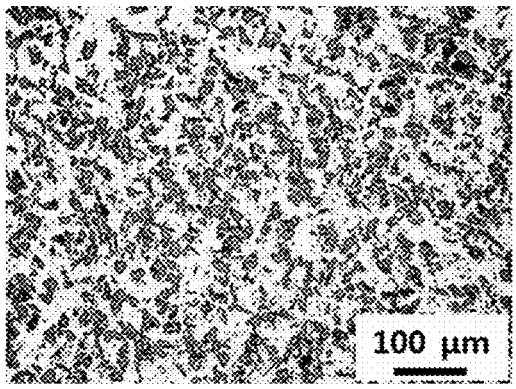
FIG. 3(a)
FIG. 3(b)
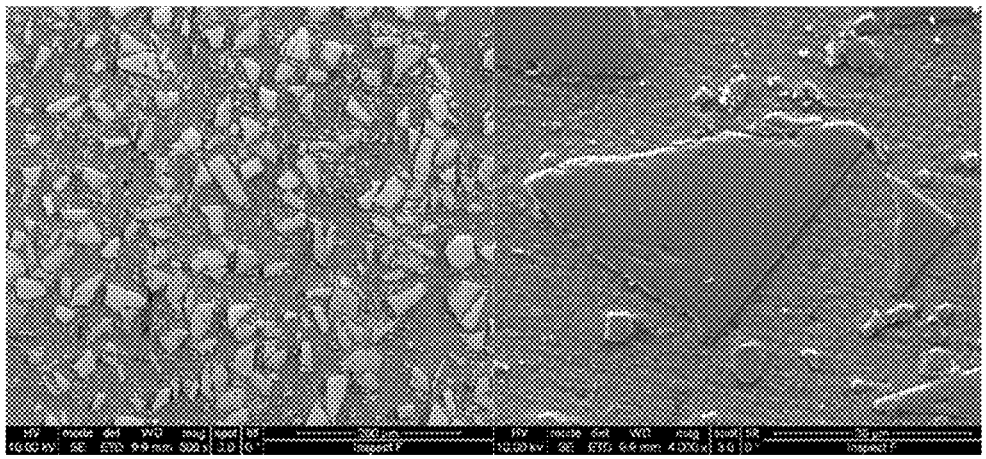

METHOD OF FABRICATING AN ALUMINUM MATRIX COMPOSITE AND AN ALUMINUM MATRIX COMPOSITE FABRICATED BY THE SAME

CROSS REFERENCES TO PRIOR APPLICATIONS

This application claims priority of Korean Patent Application No. 10-2014-0180608 filed on Dec. 15, 2014 and Korean Patent Application No. 10-2015-0089370 filed on Jun. 24, 2015, which are all hereby incorporated by reference in their entirety.

BACKGROUND OF INVENTION

The present invention relates to a fabricating method of an aluminum matrix composite, more particularly, to a fabricating method of an aluminum matrix composite by means of simply heating a mixture of aluminum powder and a ceramic reinforcing phase under a nitrogen or an ammonium atmosphere (10-100 vol. %) whose concentration may be adjusted by mixing with non-oxidizing gases such as argon or hydrogen, and an aluminum matrix composite fabricated by said method.

Metal matrix composites (MMCs) reinforced by various forms of ceramic phases such as particles, whiskers and fibers etc. have much better characteristics than the respective individual constituent materials because they combine the characteristics of the metal matrix (ductility and toughness) and the characteristics of ceramic materials (high strength and stiffness). Especially, since the overall properties of the two materials are very different (such as physical, thermal, electrical and mechanical properties etc.), in particular, MMCs have the advantage of possessing a possibly wide spectrum of properties between metals and ceramics. This is because a virtually countless number of combinations are possible if one changes the metal matrix and the type, size, form and relative amount of the reinforcing phase. Therefore through an appropriate combination of such parameters, properties of MMCs can be tailored to satisfy the conditions of their final usage.

Recently through significant advances in MMCs, their applications can be found in land transportation (automobiles and railways), thermal management, aerospace and industrial etc. From recreational to basic industry, not only are they being applied in hi-tech industries but also in our everyday life.

Among various metals applied, nearly 70% of all commercial MMCs in the global market are Al MMCs. Typical commercial methods of manufacturing them are stir casting, liquid phase infiltration and powder metallurgy. MMCs are made by incorporating a ceramic reinforcing phase into a metal matrix. However, since the overall properties of the two materials are greatly different, it is difficult to incorporate the reinforcing phase into the metal matrix. Therefore, in order to overcome this problem, a method involving high energy mixing is performed (e.g. stir casting), or a method involving infiltration of a melt under high pressure into a preform is conducted (e.g. liquid phase infiltration) or a method involving mixing powders then consolidating them under pressure followed by sintering is performed (e.g. powder metallurgy). Nevertheless, all these processes require additional equipment to manufacture MMC products and therefore contribute to the overall cost as cost increasing factors.

In addition, the processes mentioned above have limitations in types of reinforcing phases and volume fractions that could be applied. Ironically, the respective additional processes can also cause detrimental effects to the properties of the final product.

Although, the global market for MMCs, unlike in the past, is expected to grow 6.6% annually by 2019 through technical innovation, its market size is actually still relatively small compared to other materials. One of the most important reasons for this is that the cost competitiveness of MMCs is still fairly low with respect to other competing materials. In order to overcome such problems, research on low cost large output processing technologies is being performed actively around the world.

Therefore, if a simpler process that did not need additional equipment like the conventional processes were to be developed and thus be more cost competitive, it can provide the opportunity to greatly expand the application of MMCs.

The present invention regards to a method of fabricating Al composites using an absolutely new concept that does not require complex equipment.

SUMMARY OF INVENTION

One aspect of the present invention may be a method for fabricating an aluminum matrix composite comprising; heating a mixture of aluminum and a ceramic reinforcing phase in a nitrogen containing atmosphere.

The heating process in said nitrogen containing atmosphere may comprise the following steps;

1) aluminum powder reacts with nitrogen to form a nitride;
2) aluminum powder melts by the exothermic heat due to nitridation;
3) reinforcing phase provides a constant passageway for nitrogen supply while molten aluminum fills pores within the powder bed without application of pressure.

The heating is held for a duration of more than 30 minutes, and preferably for 60-120 minutes.

Aluminum may comprise powders, particles, flakes or combinations thereof.

Aluminum may comprise pure aluminum, aluminum alloys or a combination thereof; said aluminum alloy may comprise one or more elements selected from the group consisting of magnesium, silicon, copper, manganese and zinc.

The reinforcing phase may comprise at least one ceramic selected from the group consisting of oxides, carbides, borides and nitrides, or combinations thereof; said oxides may comprise at least one oxide selected from a group consisting of $Al_2O_3$, MgO, $TiO_2$ and $ZrO_2$, or combinations thereof; said carbides may comprise at least one carbide selected from a group consisting of SiC, TiC and $B_4C$, or combinations thereof; said boride may comprise $TiB_2$; and said nitrides may comprise at least one nitride selected from a group consisting of AlN, TiN and $Si_3N_4$, or combinations thereof.

The ceramic reinforcing phase may comprise particles, fibers, whiskers or combinations thereof.

The ceramic reinforcing phase may consist of 0-80 volume % of the total mixture, and preferably 0-60 volume % of the total mixture.

The nitrogen containing atmosphere may comprise one or more gases selected from the group consisting of nitrogen gas and ammonium gas; wherein nitrogen containing atmosphere comprises nitrogen gas or ammonia gas diluted in either argon gas or hydrogen gas.

The nitrogen containing atmosphere may comprise nitrogen gas or ammonia gas with a concentration of 10 to 100 volume %.

The heating temperature may be 590° C. to 1000° C., and preferably 600° C. to 800° C.; and duration of heating may be at least 30 minutes, and preferably 60-120 minutes.

Another aspect of the present invention is the aluminum matrix composite fabricated by the method of the previous aspect.

BRIEF DESCRIPTION OF THE DRAWINGS

References will be made to embodiments of the invention, examples of which may be illustrated in the accompanying figures. These figures are intended to be illustrative, not limiting. Although the invention is generally described in the context of examples or embodiments, it should be understood that it is not intended to limit the scope of the invention to these particular examples or embodiments.

FIG. 2 shows an optical micrograph of a microstructure of a composite fabricated according to Example 7, where dark colored SiC particles are shown to be surrounded by a light colored Al substrate;

FIG. 3(*a*) shows a SEM image of a composite fabricated according to Example 45 at low magnification and FIG. 3(*b*) shows the same at high magnification, where light colored SiC particles are shown to be surrounded by a grey colored Al substrate;

DETAILED DESCRIPTION OF THE PRESENT INVENTION

Figure 1A:
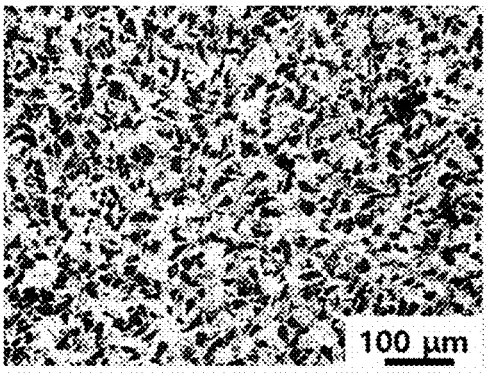
FIG. 1(*a*) shows an optical micrograph and FIG. 1(*b*) an XRD pattern of a composite according to Example 2. Dark colored $Al_2O_3$ particles are shown to be surrounded by a light colored Al substrate.

In the following description, for the purposes of explanation, specific details and examples are set forth in order to provide an understanding of the invention. It will be apparent, however, to one skilled in the art that the invention can be practiced without these details. One skilled in the art will recognize that exemplary embodiments of the present invention, described below, may be performed in a variety of ways and using a variety of means. Those skilled in the art will also recognize additional modifications, applications, and embodiments are within the scope thereof, as are additional fields in which the invention may provide utility. Accordingly, the embodiments described below are illustrative of specific embodiments of the invention and are meant to avoid obscuring the invention.

Furthermore, connections between method steps are not restricted to connections that are effected directly. Instead, connections between method steps may be modified or otherwise changed through the addition thereto of intermediary method steps, without departing from the teachings of the present invention.

According to the present invention, an aluminum matrix composite, in which a ceramic reinforcing phase is uniformly distributed, may be fabricated by means of a simple heating process of a mixture of aluminum and ceramic reinforcing phase, in a nitrogen containing atmosphere.

Heat that is generated during nitridation melts aluminum thereby, making it possible to fabricate an aluminum matrix composite, at temperatures even lower than the melting temperature of aluminum as well as at temperatures higher.

Aluminum nitride formed in-situ as a result of nitridation of aluminum may act as another reinforcing phase and as the composite may be fabricated at a lower temperature than conventional processes, the formation of reaction products at the interface between the aluminum matrix and the ceramic reinforcing phase is greatly suppressed thereby making it possible to obtain an aluminum matrix composite with good characteristics.

The present invention relates to a fabricating method of an aluminum matrix composite and an aluminum matrix composite fabricated by the same.

An aspect of the present invention is a method of fabricating an aluminum matrix composite characterized by heating a mixture of aluminum and a ceramic reinforcing phase in a nitrogen containing atmosphere.

The present aspect features a method of fabricating an aluminum matrix composite by simply heating the aluminum and ceramic mixture thereby increasing process efficiency and markedly decreasing production costs. The present aspect is elaborated below.

First, a mixture of aluminum and a ceramic reinforcing phase is prepared.

The general method of mixing powders (e.g. hand mixing, roll mixing, ball mixing etc.) may be used to mix aluminum powder with the ceramic reinforcing phase. In order to obtain a uniform powder mixture any known method in the art may be used. It is very important that aluminum and ceramic are mixed uniformly because the ceramic must be evenly dispersed in the aluminum matrix through-out the volume to obtain an aluminum matrix composite with superior characteristics.

Aluminum may be in the form of particles, flakes, powders or any combination thereof. The use of aluminum in powder form is desirable.

Aluminum may be pure aluminum, any aluminum alloy or a combination thereof. Aluminum alloys may comprise one or more elements selected from the group consisting of magnesium, silicon, copper, manganese and zinc. As for aluminum alloys, alloyed powders of A5052, A6061, A356, A7075 may be used or a powder mixture composing each element powder that constitutes the alloy composition, respectively, may be used.

A ceramic reinforcing phase may be in the form of particles, fiber or whisker, or combinations thereof. The use of ceramic in powder form is desirable.

Depending on the requirements of the final product, a ceramic reinforcing phase may comprise at least one ceramic selected from the group consisting of oxides, carbides, borides and nitrides, or combinations thereof. However, other ceramic materials may be included and is not limited to the aforementioned ceramics.

Said oxides may comprise at least one oxide selected from a group consisting of $Al_2O_2$, MgO, $TiO_2$ and $ZrO_2$, or combinations thereof, said carbides may comprise at least one carbide selected from a group consisting of SiC, TiC and $B_4C$, or combinations thereof, said borides may comprise $TiB_2$, said nitrides may comprise at least one nitride selected from a group consisting of AlN, TiN and $Si_3N_4$, or combinations thereof. However, other ceramic reinforcing phases may be included and is not limited to the aforementioned ceramics.

A composite fabricated according to the present invention has a microstructure with a ceramic phase dispersed in an aluminum matrix wherein the ceramic phase being added as the reinforcing phase may have its type, form, size, and relative amount be adjusted to tailor the properties of the resulting composite.

It is possible to have 0 to 80 volume percent of a ceramic reinforcing phase in the total mixture. In case the volume fraction of the ceramic reinforcing phase is larger than 60%, however, there may be a problem that nitridation is too excessive to make a sound composite. Therefore, a volume fraction of ceramic reinforcing phase up to 60% is preferable.

The amount of a ceramic reinforcing phase in a fabricated composite is determined by the amount charged in the powder mixture. Since the amount of ceramic reinforcing phase can be adjusted freely within the aforementioned range, a composite having suitable properties for a particular use may be fabricated.

Mixture of aluminum and a ceramic reinforcing phase may be a powder bed. However, it may not be limited to this and may be a powder mixture prepared into a certain form, for example, a preform. The form may be any arrangement as long as nitrogen from a nitrogen containing atmosphere permeates into the mixture and reacts with aluminum to form aluminum nitride.

Next, a mixture of aluminum and a ceramic reinforcing phase may be heated in a nitrogen containing atmosphere to fabricate an aluminum matrix composite.

A nitrogen containing atmosphere may be achieved by means of nitrogen ($N_2$) gas or ammonia gas ($NH_3$) gas.

Pure nitrogen ($N_2$) gas of 99.9% or higher may be used or a mixture of nitrogen ($N_2$) with a diluting non-oxidizing gas such as argon (Ar) or hydrogen ($H_2$) may be used. A non-oxidizing gas means a gas which does not react with aluminum under fabrication conditions such as an inert gas or a reducing gas.

During the heating process, nitrogen provided by the atmosphere may react with aluminum in the mixture and form aluminum nitride (AlN) in-situ. Since such nitridation is an exothermic reaction, aluminum may be melted by the exothermic heat. The molten aluminum, thus may form a matrix in which ceramic is dispersed to form an aluminum metal matrix composite (Al MMC).

The powder mixture may be placed in a furnace and then be heated or may be charged into a heated furnace at a certain temperature. A gas including nitrogen may be allowed to flow in to the furnace at room temperature or be pre-heated to a certain temperature before being introduced.

Heating can be performed in the following manner. For example, heat with a heating rate of 5° C./min from room temperature to a pre-set temperature and hold for a duration of at least 30 minutes, and preferably 60-120 minutes. The preset temperature may be 590° C. to 1000° C. If the temperature is lower than 590° C., nitridation is insufficient and there is not enough heat provided by the exothermic nitridation reaction which leads to incomplete melting of the aluminum powder and the appearance of pores thus making the resulting composite undesirable. If the temperature is higher than 1000° C., excessive reactions at the matrix-reinforcement interface may lead to a composite with poor properties and contribute to increasing the fabrication costs for the composite. Preferably the temperature range is 600° C.~800° C.

When an aluminum and ceramic reinforcing phase is heated in a nitrogen containing atmosphere, aluminum within the mixture and nitrogen from the atmosphere react so that nitridation of aluminum occurs. This reaction has the same mechanism as the direct nitridation of aluminum to form aluminum nitride, and is known to be a very 'intense exothermic reaction.

According to the present invention, aluminum composites can be fabricated not only at temperatures lower (e.g. 590° C.) than the melting point of aluminum (660° C.) but also at very high temperatures (e.g. 1,000° C.). The reason it is possible to fabricate composites at temperatures lower than the melting temperature of aluminum is because heat from the exothermic nitridation reaction is exploited. While, there is a minimum temperature at which aluminum matrix composites may be fabricated according to the present invention, there is no limit to the higher end of temperature. However, considering economics and to suppress undesirable interfacial reactions between aluminum and the ceramic reinforcing phase, it is desirable to have a lower fabrication temperature.

Degree of nitridation can be controlled by manipulating the type of ceramic reinforcing phase, its amount and size, the amount and size of aluminum powder and addition of alloying elements, temperature, time and the concentration and amount of nitrogen gas. Under same fabrication conditions, degree of nitridation may be controlled by manipulating the size and relative amount of ceramic reinforcing phase and aluminum powder. This is because the extent of exothermic reaction is determined by the aforementioned conditions and degree of nitridation is, in turn determined by the extent of exothermic reaction.

Degree of nitridation is defined as the ratio of aluminum converted to aluminum nitride. Theoretically, if aluminum is completely converted to aluminum nitride, there would be approximately a 52% increase in weight. Degree of nitridation can be calculated from the weight change of the crucible before and after heating.

In the case of heating below the melting temperature of aluminum, since nitridation of aluminum occurs first and thereafter the melting of aluminum to form an aluminum matrix composite by means of the heat associated with nitridation, there is a need to control the nitridation degree of aluminum. If the degree of nitridation is too low, there may not be enough exothermic heat to melt the aluminum powder resulting in only partial or no melting and thus an unsound composite, likewise if the degree of aluminum nitridation is too high (e.g. over 50%), almost all aluminum may be converted to aluminum nitride leaving little aluminum left to melt and thus may result in an unsound composite.

The degree of aluminum nitridation may be adjusted by various process variables. These variables may include size and amount of aluminum powder, existence or absence of alloying element, the type, size and amount of the ceramic reinforcing phase, the amount and concentration of nitrogen gas, fabrication temperature and time.

As described above, since it is possible to combine such a variety of parameters, it is possible to fabricate composites of various properties within the same aluminum matrix—ceramic reinforcing phase system. This is another advantage of the present invention.

In the case the composite is fabricated below the melting temperature of aluminum, the interfacial reaction between the aluminum matrix and ceramic reinforcing phase can be significantly suppressed. As excessive interfacial reactions occurring during the fabrication of a composite may weaken its properties, chemical stability between the matrix and the reinforcing phase is very important.

For example, in the case where SiC is added as the reinforcing phase to the aluminum matrix, since composites were fabricated conventionally above the melting temperature of aluminum, the formation of $Al_4C_3$ at the interface was inevitable. $Al_4C_3$ is very brittle and may react with moisture and thus deteriorate the characteristics of the composite. In order to prevent the formation of $Al_4C_3$, it was necessary to add more than the threshold amount (minimum 7 wt %) of Si. However, according to the present invention, since the fabrication temperature is far below the melting temperature of aluminum, composites with almost no formation of $Al_4C_3$ may be fabricated.

A composite of the present aspect may include an aluminum nitride formed by nitridation. The amount of aluminum nitride formed may be adjusted by type, size and amount of a ceramic phase, size and amount of aluminum powder, the existence or absence of an alloying element, heating temperature and duration, and nitrogen concentration of gas. Aluminum nitride formed by nitridation may act as an additional reinforcing phase. If a proper combination is used of the in-situ formed aluminum nitride and the artificially added ceramic reinforcing phase, a variety of characteristics not attainable with just the artificially added ceramic reinforcing phase alone may be obtained. For example, in the case of adding a relatively small volume fraction of SiC, by adjusting the amount of in-situ formed AlN, it may have the same effect of adding a high volume fraction of SiC.

In the present aspect, aluminum nitride may be dispersed discontinuously in the aluminum matrix.

Another aspect of the present invention is an aluminum matrix composite material fabricated according to the preceding aspect.

Hereinafter, the present invention will be described in detail by examples and comparative examples. However, the scope of the invention is not limited to these examples.

EXAMPLES 1-13

First, aluminum powder (Duksan reagents, CAS 7429-90-5, 325 mesh, 99.9%) and as for ceramic powder, SiC (Showa Denko, C#600J) powder or $Al_2O_3$ powder (Showa Denko, WA#600J) was prepared as the starting materials.

Next, the aforementioned starting materials were weighed according to compositions listed in Table 1 and put into plastic containers after which uniform powder mixtures were obtained by hand shaking the containers.

Next, the aforementioned powder mixture was loaded into a crucible with pour density and then was transferred into a furnace having a controlled atmosphere. The powder mixture was heated according to the conditions stated in Table 1 for 1-2 hours and then cooled to obtain aluminum matrix composites.

TABLE 1

| | Powder mixture composition (Vol %) | | | Gas atmosphere | | Heating | |
|---|---|---|---|---|---|---|---|
| | | Ceramic reinforcing phase | | | | | |
| Example | Al | SiC | $Al_2O_3$ | Comp. (Vol %) | Amount (L/min) | Temp. (° C.) | Time (min) |
| 1 | 70 | 30 | 0 | $N_2$ | 2 | 640 | 60 |
| 2 | 70 | 0 | 30 | $N_2$ | 2 | 640 | 60 |
| 3 | 50 | 50 | 0 | $N_2$ | 3 | 640 | 60 |
| 4 | 60 | 0 | 40 | $N_2$ | 3 | 640 | 60 |
| 5 | 80 | 20 | 0 | $N_2$ | 3 | 700 | 20 |
| 6 | 80 | 20 | 0 | $N_2$ | 3 | 700 | 30 |
| 7 | 80 | 20 | 0 | $N_2$ | 3 | 700 | 60 |
| 8 | 70 | 30 | 0 | $N_2$ | 3 | 700 | 60 |
| 9 | 50 | 50 | 0 | $N_2$ | 3 | 700 | 60 |
| 10 | 60 | 40 | 0 | $N_2$ | 0.5 | 700 | 60 |
| 11 | 70 | 30 | 0 | $N_2$/Ar 20/80 | 0.5 | 700 | 60 |
| 12 | 70 | 30 | 0 | $N_2$ | 1 | 700 | 60 |
| 13 | 70 | 30 | 0 | $N_2$/Ar 20/80 | 1 | 700 | 60 |

Figure 1B:
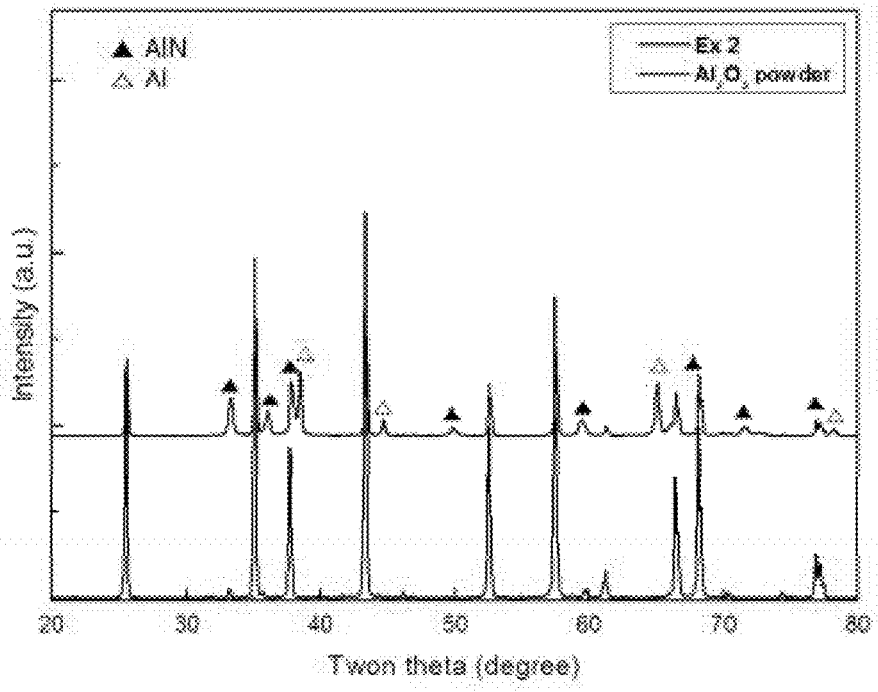

FIG. 1(*a*) shows an optical micrograph image and FIG. 1(*b*) shows XRD analysis results of a composite fabricated according to the conditions of Example 2. Referring to FIG. 1(*a*), alumina particles (shown in dark color) are uniformly dispersed in the aluminum matrix (shown in light color) thus confirming that it is possible to fabricate an aluminum matrix composite at a temperature 20 degrees below (640° C.) the melting temperature of aluminum (660° C.). Referring to the XRD analyses of the fabricated composite shown in FIG. 1(*b*), it can be seen that the peaks representing aluminum nitride as well as aluminum and alumina (baseline peaks) are detected. Therefore, it can be verified that aluminum nitride is formed by the nitridation of aluminum powder during the fabrication process.

FIG. 2 shows the microstructure image of a composite fabricated according to the conditions of Example 7 taken by an optical microscope. It can be seen in FIG. 2 that SiC particles (shown in dark color) are uniformly dispersed in the aluminum matrix (shown in light color).

EXAMPLES 14-20

An Al-3 wt. % Mg powder mixture was used instead of Al powder and TiC, $B_4C$ or $TiB_2$ were added to the ceramic reinforcing phase. All other conditions were identical to the conditions of Example 1 for fabricating the aluminum matrix composite except for the gas amount and fabrication temperature. Composites were obtained in all examples.

TABLE 2

| | Composition of powder mixture | | | | | | | |
|---|---|---|---|---|---|---|---|---|
| | Al matrix | Volume fraction of ceramic reinforcing phase (Vol. %) | | | | | Amount of Gas | Temp. |
| Example | (wt. %) | SiC | $Al_2O_3$ | TiC | $B_4C$ | $TiB_2$ | (L/min) | (° C.) |
| 14 | Al—3Mg | 0 | 30 | 0 | 0 | 0 | 6 | 600 |
| 15 | Al—3Mg | 30 | 0 | 0 | 0 | 0 | 6 | 600 |
| 16 | Al—3Mg | 30 | 0 | 0 | 0 | 0 | 5 | 590 |
| 17 | Al—3Mg | 0 | 30 | 0 | 0 | 0 | 5 | 590 |
| 18 | Al—3Mg | 0 | 0 | 30 | 0 | 0 | 5 | 600 |
| 19 | Al—3Mg | 0 | 0 | 0 | 30 | 0 | 5 | 600 |
| 20 | Al—3Mg | 0 | 0 | 0 | 0 | 30 | 5 | 600 |

Referring to Table 2, it was confirmed that composites may be fabricated at temperatures much lower (590~600° C.) than the melting temperature of aluminum (660° C.) by adding Mg to the powder mixture.

EXAMPLES 21-38

In this series of examples, changes in the degree of nitridation according to varying sizes and volume fraction of the ceramic reinforcing phase and varying compositions of the matrix were examined.

Powder mixtures were prepared by mixing aluminum powder and SiC powder in a spex mill for 5 minutes according to the compositions listed in Table 3. The amount of powder mixture used in each example was fixed to 40 g. Degree of nitridation was measured from the change in weights before and after heating the samples in a nitrogen atmosphere with a flow rate of 2 L/min at 700° C. for 1 hour and then cooling to room temperature. The results are shown in Table 3.

TABLE 3

| | Composition of powder mixture (Vol %) | | |
|---|---|---|---|
| Example | Al | SiC (Size, Fraction) | Degree of Nitridation (%) |
| 21 | pure | 3 μm, 15% | 20.0 |
| 22 | | 3 μm, 20% | 40.7 |
| 23 | | 3 μm, 25% | 46.5 |
| 24 | | 5.5 μm, 15% | 4.9 |
| 25 | | 5.5 μm, 20% | 6.3 |
| 26 | | 5.5 μm, 25% | 27.9 |
| 27 | | 8 μm, 15% | 3.2 |
| 28 | | 8 μm, 20% | 4.1 |
| 29 | | 8 μm, 25% | 5.0 |
| 30 | 6061 | 3 μm, 15% | 5.5 |
| 31 | | 3 μm, 20% | 26.1 |
| 32 | | 3 μm, 25% | 30.1 |
| 33 | | 5.5 μm, 15% | 2.5 |
| 34 | | 5.5 μm, 20% | 3.9 |
| 35 | | 5.5 μm, 25% | 12.0 |
| 36 | | 8 μm, 15% | 1.9 |
| 37 | | 8 μm, 20% | 2.3 |
| 38 | | 8 μm, 25% | 2.7 |

Referring to Table 3, it can be seen that for the same particle size of reinforcing phase, degree of nitridation increases with increasing volume fraction of the reinforcing phase. Also for the same volume fraction of a reinforcing phase, degree of nitridation decreases with increasing particle size of the reinforcing phase.

It is confirmed that a composite fabricated consistent with the method of the present invention may have a changing degree of nitridation according to the size and volume fraction of the reinforcing phase and the composition and size of the aluminum matrix. For example, in the case of SiC powder of 5.5 μm dispersed as the reinforcing phase, as the volume fraction of it increases from 15% (Example 24) to 20% (Example 25) and again to 25% (Example 26), the degree of nitridation increases from 4.9% to 6.3% and to 27.9%, respectively. This ensues because the ceramic reinforcing phase provides a passageway for the supply of nitrogen and suggests that more nitrogen can be supplied internally as the volume fraction of ceramic reinforcing phase increases. In the case the volume of SiC dispersed is fixed at 15%, as the size of the SiC particles increases from 3 μm (Example 21) to 5.5 μm (Example 24) and again to 8 μm (Example 27), the degree of nitridation decreases from 20% to 4.9% and to 3.2%. This is explained by the surface area increasing per unit volume fraction as the size of the reinforcing phase becomes smaller thereby securing more passageways for nitrogen supply.

These results represent the unique advantages of the present invention that cannot be obtained through conventional fabrication methods. In other words, for the same Al—SiC composites, different degrees of nitridation may be obtained by varying the size and volume fraction of SiC and size and composition of the aluminum matrix.

Since in-situ formed aluminum nitride during the fabrication process of the composites may act as a secondary reinforcing phase together with the artificially added reinforcing phase, it is possible to improve the characteristics of the composites by adjusting the degree of nitridation.

Adjusting the degree of nitridation is possible by varying the process parameters and since the combination of process parameters is virtually countless, it is possible to fabricate composite materials with almost any desired characteristics.

EXAMPLES 39-42

In the present series of examples, the amount of the powder mixture of aluminum and SiC was increased to 1 kg, in order to examine the performance of larger scale composites. A powder mixture composed of SiC powder (Showa Denko, C#320J) and pure aluminum powder was prepared by roll mixing (400 rpm, 2 hrs) according to the compositions shown in Table 4.

Next, the powder mixture was put into a crucible with pour density, then placed in the furnace, where it was heated according to the conditions shown in Table 4 and then naturally cooled to obtain aluminum matrix composites. The coefficient of thermal expansion (CTE) and thermal conductivity (TC) were measured of the fabricated composites with their results shown in Table 4.

TABLE 4

| Example | SiC (size, Vol %) | $N_2$ (L) | Temp (° C.) | Time (hr) | Degree of Nitridation (%) | CTE (μm/(m * ° C.)) | TC (W/(m * K)) |
|---|---|---|---|---|---|---|---|
| 39 | 40 μm, 20% | 1 | 665 | 1 | 3.4 | 19.11 | 168 |
| 40 | 40 μm, 30% | 3 | 665 | 1 | 3.1 | 16.78 | 132 |
| 41 | 40 μm, 40% | 3 | 665 | 1 | 3.4 | 15.61 | 145 |
| 42 | 40 μm, 50% | 3 | 665 | 1 | 9.8 | 11.15 | 112 |

It can be seen that large scale composites were obtained regardless of the volume fraction of reinforcing phase at 665° C., slightly above the melting temperature of aluminum.

EXAMPLES 43-50

In this series of examples, 6063 aluminum alloy composition was used for the powder mixture instead of pure aluminum to obtain large scale composites.

First, 0.6 wt % Si, 0.1 wt % Cu, 0.9 wt % Mg, and 0.1 wt % Zn powder were added to aluminum powder to make a powder mixture corresponding to the composition of an 6063 aluminum alloy.

Next, 17.5-50 vol % of SiC powder was added to the mixture according to Table 5 for roll mixing (400 rpm, 2 hrs.) and prepared in lkg powder mixtures. The average size of the SiC powder (Showa Denko, C#320J, C#800J) was 14 μm and 40 μm.

Next, the aforementioned powder mixture was put in a crucible with pour density and then placed into a furnace for heating according to the conditions indicated in Table 5 and then cooled naturally to obtain aluminum matrix composites. It should be noted that Elastic modulus (E), Tensile strength (UTS), Yield strength (YS) and Elongation (EL) in Table 5 were obtained after T6 heat treatment.

TABLE 5

| Ex. | SiC | Temp. (° C.) | $N_2$ (L) | Al (μm) | Time (hr) | Degree of Nitridation | CTE um/ (m * ° C.) | E (GPa) | YS (MPa) | UTS (MPa) | EL (%) |
|---|---|---|---|---|---|---|---|---|---|---|---|
| 43 | 40 μm, 17.5% | 665 | 3 | 10 | 1.5 | 1.5 | 20.14 | 84 | 328.6 | 335.9 | 4.4 |
| 44 | 14 μm, 17.5% | 665 | 3 | 70 | 2 | 0.5 | 22.48 | 105 | 306 | 381 | 10 |
| 45 | 40 μm, 25% | 665 | 3 | 10 | 1.5 | 1.5 | 19.57 | 90 | 336 | 387 | 4.2 |
| 46 | 14 μm, 25% | 665 | 3 | 70 | 2 | 0.7 | 17.65 | 110 | 347 | 420 | 6.4 |
| 47 | 40 μm, 40% | 665 | 3 | 10 | 2 | 2.4 | 14.88 | 76 | 312 | 316 | 0.6 |
| 48 | 14 μm, 40% | 665 | 3 | 70 | 2 | 3.5 | 17.96 | 137 137 | | 378 | |
| 49 | 40 μm, 50% | 665 | 3 | 10 | 1.5 | 7.9 | 12.79 | 1 | | 175 | 0.2 |
| 50 | 14 μm, 50% | 665 | 3 | 70 | 2 | 25.3 | 8.94 | | | | |

The tensile properties and coefficient of thermal expansion (CTE) of the fabricated composite materials are shown in Table 5. The general properties of composite materials fabricated according to the method of the present invention show similar results with those fabricated using conventional commercial methods. Since similar results have been obtained using a relatively simple method in comparison to conventional ones, it is evident that the new method proposed by the present invention is more economic because it can largely reduce fabrication costs.

FIG. 3(*a*) and FIG. 3(*b*) are scanning electron microphotographs of a composite fabricated according to Example 45. It can be seen that SiC particles (light colored particles) are uniformly distributed within the aluminum matrix (grey colored background) in FIG. 3(*a*) taken at lower magnification. In addition, it can be seen that no reaction products are present at the particle-matrix interface in FIG. 3(*b*) taken at higher magnification.

EXAMPLES 51-54

In this series of examples, aluminum matrix composites were fabricated according to the same conditions as example 43, except for the change in composition of the aluminum matrix and the size of SiC being changed to 10 μm. Fabrication conditions and tensile characteristics of the fabricated composite material are listed in Table 6. It should be noted that Elastic modulus (E), Tensile strength (UTS), Yield strength (YS) and Elongation (EL) were obtained after T6 heat treatment for examples listed in Table 6 except for Example 54, which was obtained after T4 heat treatment.

TABLE 6

| Ex. | SiC | Alloy | Temp. (° C.) | N2 (L) | Al (μm) | Time (hr) | Degree of Nitridation | E (GPa) | YS (MPa) | UTS (MPa) | EL (%) |
|---|---|---|---|---|---|---|---|---|---|---|---|
| 51 | 10 μm, 17.5% | 6061 | 665 | 3 | 10 | 1.5 | 1.5 | 84 | 328.6 | 335.9 | 4.4 |
| 52 | 10 μm, 17.5% | 7075 | 665 | 3 | 70 | 2 | 0.5 | 105 | 306 | 381 | 10 |
| 53 | 10 μm, 15% | 7050 | 665 | 3 | 10 | 1.5 | 1.5 | 90 | 336 | 387 | 4.2 |
| 54 | 10 μm, 17.5% | 2009 | 665 | 3 | 70 | 2 | 0.7 | 110 | 347 | 420 | 6.4 |

Referring to table 6, it can be seen that not only the strength but also the ductility of the fabricated composites are relatively good.

Figure 4:
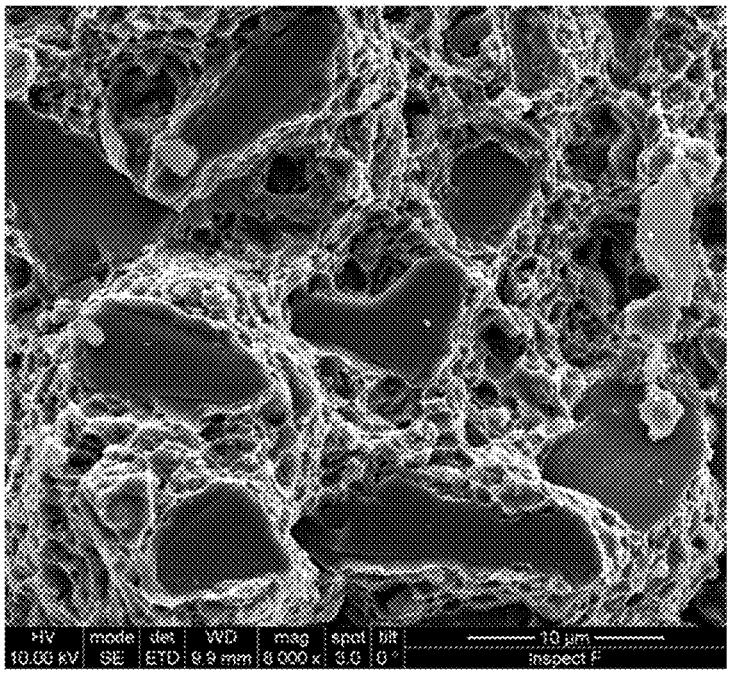
FIG. 4 shows a SEM image of a fractured surface of a composite fabricated according to Example 53, where dark colored SiC particles are shown to be surrounded by a light colored Al matrix.

A microphotograph of the fractured surface of the 7050 aluminum alloy matrix composite fabricated according to Example 53 is shown in FIG. 4, where the darker SiC particles are shown to be surrounded by the lighter Al matrix. A good interface and ductile fracture behavior is observed.

COMPARATIVE EXAMPLES 1-4

In this series of comparative examples, aluminum matrix composites were fabricated according to Example 21, except for using argon gas instead of nitrogen gas. Fabrication conditions and resulting degrees of nitridation are presented in Table 7.

TABLE 7

| Comparative Example | Reinforcing Phase (Size, Vol. fraction) SiC | $Al_2O_3$ | Al composition | Argon Gas (L) | Temp. (° C.) | Degree of Nitridation (%) |
|---|---|---|---|---|---|---|
| 1 | 10 μm, 30% | 0 | Pure | 2 | 700 | 0 |
| 2 | 20 μm, 30% | 0 | Pure | 2 | 700 | 0 |
| 3 | 10 μm, 17.5% | 0 | 6061 | 2 | 700 | 0 |
| 4 | 0 | 20 μm, 30% | 6061 | 2 | 700 | 0 |

Figure 5:
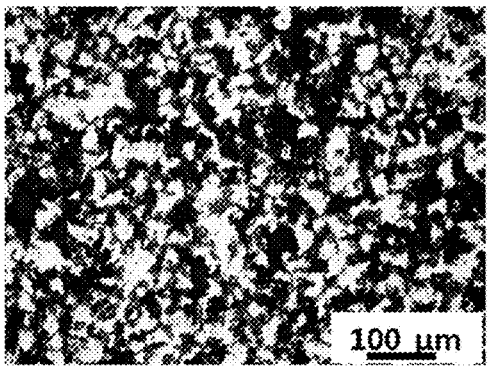
FIG. 5 shows an optical micrograph of a composite fabricated according to Comparative Example 4, where dark colored pores are shown to surround the gray colored $Al_2O_3$ particles and a light colored Al matrix.

Although composites were obtained, nitridation did not occur in any of the comparative examples listed in Table 7. However, after solidification, it was observed that a considerable amount of aluminum flowed out from the powder bed and was in a metallic state whereas numerous amounts of pores were observed within the composite due to a lack of aluminum. Thus, the quality of the resulting composites was poor. FIG. 5 shows an optical micrograph of the microstructure of the fabricated composite according to comparative example 4. The existence of numerous dark colored pores surrounding the gray $Al_2O_3$ particles and the light Al matrix in the fabricated composite can be observed, for which the lack of aluminum is the cause.

Judging from the results, it can be confirmed that a certain amount of nitrogen is indispensable for the fabrication of composites with sound microstructures.

What is claimed is:

1. A method for fabricating an aluminum matrix composite comprising:

heating a uniformly mixed mixture of aluminum and a ceramic reinforcing phase in a nitrogen containing atmosphere, from room temperature to a temperature in the range of 590° C.-660° C. employing a constant heating rate, and;

maintaining the temperature within said range for a duration of 60~120 minutes such that the resulting composite comprises the ceramic reinforcing phase dispersed throughout the aluminum matrix;

wherein the heating further comprises the steps of:

an oxide film covering the aluminum surface reacting with the nitrogen to form a nitride;

the aluminum melting due to heat caused by the nitriding reaction;

the ceramic reinforcing phase providing a passage for a constant supply of nitrogen such that the molten aluminum fills surrounding pores and sinters, absent externally applied pressure.

2. The method according to claim 1, wherein said aluminum comprises, pure aluminum, aluminum alloys or a combination thereof.

3. The method according to claim 2, wherein said aluminum alloy comprises one or more elements selected from the group consisting of magnesium, silicon, copper, manganese and zinc.

4. The method according to claim 1, wherein said aluminum comprises powders, particles, flakes or combinations thereof.

5. The method according to claim 1, wherein said ceramic reinforcing phase comprises at least one ceramic selected from the group consisting of oxides, carbides, borides and nitrides.

6. The method according to claim 5, wherein said oxides comprise at least one oxide selected from the group consisting of $Al_2O_3$, MgO, $TiO_2$ and $ZrO_2$.

7. The method according to claim 5, wherein said carbides comprise at least one carbide selected from the group consisting of SiC, TiC and $B_4C$.

8. The method according to claim 5, wherein said borides comprise $TiB_2$.

9. The method according to claim 5, wherein said nitrides comprise at least one nitride selected from the group consisting of AlN, TiN and $Si_3N_4$.

10. The method according to claim 1, wherein said ceramic reinforcing phase comprises particles, fibers, whiskers or combinations thereof.

11. The method according to claim 1, wherein said ceramic reinforcing phase comprises more than 0 volume % to 80 volume % percent of the total mixture.

12. The method according to claim 1, wherein said nitrogen containing atmosphere comprises one or more gases selected from the group consisting of nitrogen gas and ammonium gas.

13. The method according to claim 1, wherein said nitrogen containing atmosphere comprises nitrogen gas or ammonia gas diluted in either argon gas or hydrogen gas.

14. The method according to claim 13, wherein said nitrogen containing atmosphere comprises nitrogen gas or ammonia gas with a concentration of 10 to 100 volume %.

15. The method according to claim 1, wherein said ceramic reinforcing phase comprises more than 0 volume % to 60 volume % of the total mixture.

16. The method according to claim 1, wherein said aluminum comprises a size of 0.5-100 microns and a volume fraction of more than 0 volume % to 40 volume % of the total mixture.

17. The method according to claim 1, wherein said ceramic reinforcing phase comprises a size of 0.5-100 microns.

18. A method for fabricating an aluminum matrix composite comprising:

heating a uniform mixture of aluminum powder and a ceramic powder reinforcing phase in a nitrogen containing atmosphere, from room temperature to a temperature in the range of 590° C.~660° C. employing a constant heating rate, and;

maintaining the temperature within said range for a duration of 60~120 minutes such that the resulting composite comprises the ceramic reinforcing phase dispersed throughout the aluminum matrix;

wherein nitridation occurs in-situ at the aluminum powder surface, forming an aluminum nitride phase dispersed uniformly throughout the volume of the resulting composite;

wherein the heating further comprises the steps of:

an oxide film covering the aluminum powder surface reacting with the nitrogen to form a nitride;

the aluminum melting due to heat caused by the nitriding reaction;

the ceramic reinforcing phase providing a passage for a constant supply of nitrogen such that the molten aluminum fills surrounding pores and sinters, absent externally applied pressure.

19. The method according to claim 18, wherein size and volume fraction of said ceramic reinforcing phase comprises a size of 0.5-100 microns and a volume fraction of more than 0 volume % to 60 volume % of the total mixture.

20. The method according to claim 18, wherein said ceramic reinforcing phase comprises at least one ceramic selected from the group consisting of oxides, carbides, borides and nitrides.

21. The method according to claim 20, wherein said oxides comprise at least one oxide selected from the group consisting of $Al_2O_3$, MgO, $TiO_2$ and $ZrO_2$.

22. The method according to claim 20, wherein said carbides comprise at least one selected from the group consisting of SiC, TiC and $B_4C$.

23. The method according to claim 20, wherein said borides comprise $TiB_2$.

24. The method according to claim 20, wherein said nitrides comprise at least one selected from the group consisting of AlN, TiN and $Si_3N_4$.

25. The method according to claim 18, wherein said aluminum powder comprises a size of 0.5-100 microns and a volume fraction of more than 0 volume % to 40 volume % of the total mixture.

26. The method according to claim 18, wherein said nitrogen containing atmosphere comprises nitrogen gas or ammonia gas diluted in either argon gas or hydrogen gas.

* * * * *